US005800668A

United States Patent [19]

Bumb

[11] Patent Number: 5,800,668

[45] Date of Patent: Sep. 1, 1998

[54] AUTOMATIC TAPING APPARATUS

[76] Inventor: James Bumb, P.O. Box 603, Coloma, Calif. 95613

[21] Appl. No.: 687,084

[22] Filed: Jul. 23, 1996

[51] Int. Cl.[6] ..... B32B 31/00

[52] U.S. Cl. ..... 156/577; 156/523; 156/579

[58] Field of Search ..... 156/577, 579, 156/574, 523, 527, 391

[56] References Cited

U.S. PATENT DOCUMENTS

| | | | |
|---|---|---|---|
| 3,740,297 | 6/1973 | Vidinsky | 156/577 X |
| 4,313,780 | 2/1982 | Ford, Jr. | 156/523 |
| 4,417,941 | 11/1983 | Lin | 156/577 X |
| 5,290,390 | 3/1994 | Roman . | |
| 5,316,614 | 5/1994 | Phillips . | |
| 5,348,613 | 9/1994 | Blais | 156/574 X |
| 5,354,410 | 10/1994 | Cohen et al. . | |

OTHER PUBLICATIONS

SoMa Company Newspaper Article—Thursday, Nov. 9, 1995; San Francisco Chronicle Outdoor Section.

*Primary Examiner*—James Engel

*Attorney, Agent, or Firm*—John P. Costello

[57] ABSTRACT

An apparatus for taping work surfaces without kneeling, stooping, or bending. The apparatus is comprised of a carriage body having wheels and a push handle for imparting locomotion thereto. The push handle is located at a height sufficient for allowing a user to tape a surface from an upright walking position. The carriage body mounts a tape dispenser coupled to a tape registering device on its front surface. A roll of tape is mounted in the tape dispenser, and the tape is first fed manually to the tape registering device, which registers the tape upon a work surface. Upon firm registration, the apparatus is wheeled forward, and the tape is automatically unrolled, and applied to the work surface, until the desired amount of tape is applied. The tape dispenser and tape registering device can be uncoupled as a unit, and selectively positioned in a different geometric plane, for taping a new work surface. For example, the user can selectively tape a ground surface and then adjust the tape dispenser and tape registering device to tape a wall surface.

16 Claims, 4 Drawing Sheets

AUTOMATIC TAPING APPARATUS

BACKGROUND OF THE INVENTION

1. Field of the Invention

This invention pertains to covering a work-surface with tape, and, more specifically, to an automatic taping apparatus for allowing work surfaces in different geometric planes to be taped, without kneeling, stooping, or bending.

2. Description of the Background Art

The taping of work surfaces operates as a method of preparation for many industrial tasks. For example, a work surface may need to be covered prior to painting, to avoid over-spray. Another example lies in taping drywall junctions prior to applying a finish coat of plaster, to achieve a smooth wall texture. Another example relates to taping abutting pieces of carpet together, for purposes of hiding the carpet seams. However despite the varied utility of the taping task, the traditional method of taping work surfaces by hand, is time consuming, and labor intensive.

In an effort to more efficiently tape work surfaces, various automatic taping devices have been devised. For example, U.S. Pat. No. 5,290,390 issued to Roman et al., on Mar. 1, 1994, discloses a carpet seam tape applicator for use in joining abutting carpet pieces. This device is comprised of an elevated tape dispenser, a pair of wheels which provide locomotion to the device, and a clothes iron, which receives tape from the dispenser, and applies it to the surface to be taped. The clothes iron component disclosed in the '390 patent also serves to heat the glue on the tape to provide superior mating of the carpet pieces. This device requires a user to position himself on his hands and knees for purposes of grasping the clothes iron, and moving the device across the surface to be taped.

U.S. Pat. No. 5,316,614 issued to Phillips, on May 31, 1994, discloses a tape applicator for masking a carpet edge, comprised of a tape dispenser, a pair of rollers, a grasping handle, and a tape-registering surface. The dispenser and roller guide the tape into the tape-registering surface, which presses the tape onto the work surface. As the user kneels and drags the device upon the work surface, the tape is dispensed, and pressed onto the work surface.

U.S Pat. No. 5,354,410, issued to Cohen et al., on Oct. 11, 1994, discloses an apparatus for applying tape to a frame for glazing. This device is comprised of a large roll of tape and a guide for directing the tape onto a work surface.

Many of the foregoing patents disclose taping devices which require the user to stoop, kneel, or bend to operate. By requiring the user to first stoop or bend, these devices suffer a limitation in comfort and practicality, especially for taping long distances. Additionally, none of the above-described taping devices could be easily adjusted for taping surfaces located in different geometric planes, such as a floor surface, or alternately, a wall surface.

The present invention has solved the foregoing deficiencies by providing an automatic taping apparatus which can be used for taping work surfaces without necessitating stooping, kneeling, or bending, and, which additionally, allows the user to comfortably tape surfaces arranged in different geometric planes.

The foregoing patents reflect the state of the art of which the inventor is aware and are tendered with a view toward discharging the inventor's acknowledged duty of candor in disclosing information which may be pertinent to the patentability of the present invention. It is respectfully stipulated, however, that none of these patents teach or render obvious, singly or when considered in combination, the inventor's claimed invention.

SUMMARY OF THE INVENTION

By way of example and not of limitation, the present invention pertains to an automatic taping apparatus for taping surfaces in different geometric planes. Moreover, this device can tape surfaces more efficiently than can be accomplished by hand. Additionally, this device allows a user to tape a surface comfortably without kneeling, stooping, or bending.

This device is built around a carriage body coupled to four wheels for easy locomotion. An elongate handle shaft protrudes upward from the rear of the carriage body to a height comfortable for grasping, by a user, standing in an upright position. With this device, a user can easily grasp the handle for guiding and pushing the device along a surface to be taped, without stooping, kneeling or bending.

A tape dispenser is coupled to the front of the carriage body at a plurality of possible positions, to achieve tape dispensing in a plurality of geometric planes. Consequently, these multiple positionings of the tape dispenser allow a wall surface to be taped, and with a minor adjustment of the tape dispenser, a floor surface can be taped.

A tape register is also coupled to the tape dispenser. Upon rotating the tape dispenser, the tape register likewise rotates in an identical plane. The tape register functions to press a length of tape, against a work surface. The user then wheels the device forward, and the tape from a tape roll, being initially registered upon the work surface, is further pressed against the work surface by the tape register, as the automatic tape dispenser moves forward. In use, the tape register is positioned to either side of the carriage body and wheels, so that the tape may unroll without obstruction.

A storage basket is positioned on the top of the carriage body for placing extra rolls of tape and tools. The storage basket provides an added measure of convenience by allowing a user to replace the tape dispenser with fresh rolls of tape present in the storage basket, thereby allowing a taping task to be easily continued.

An object of the invention is to provide an automatic taping apparatus which allows a taping task to be accomplished more efficiently than by hand-taping a surface.

Another object of the invention is to provide an automatic taping apparatus which can be used to tape surfaces in different geometric planes.

A further object of the invention is to provide an automatic taping apparatus which can be comfortably operated by a user without having to stoop, kneel, or bend.

Still another object of the invention is to provide an automatic taping apparatus which allows spare rolls of tape and tools to be stored thereon.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
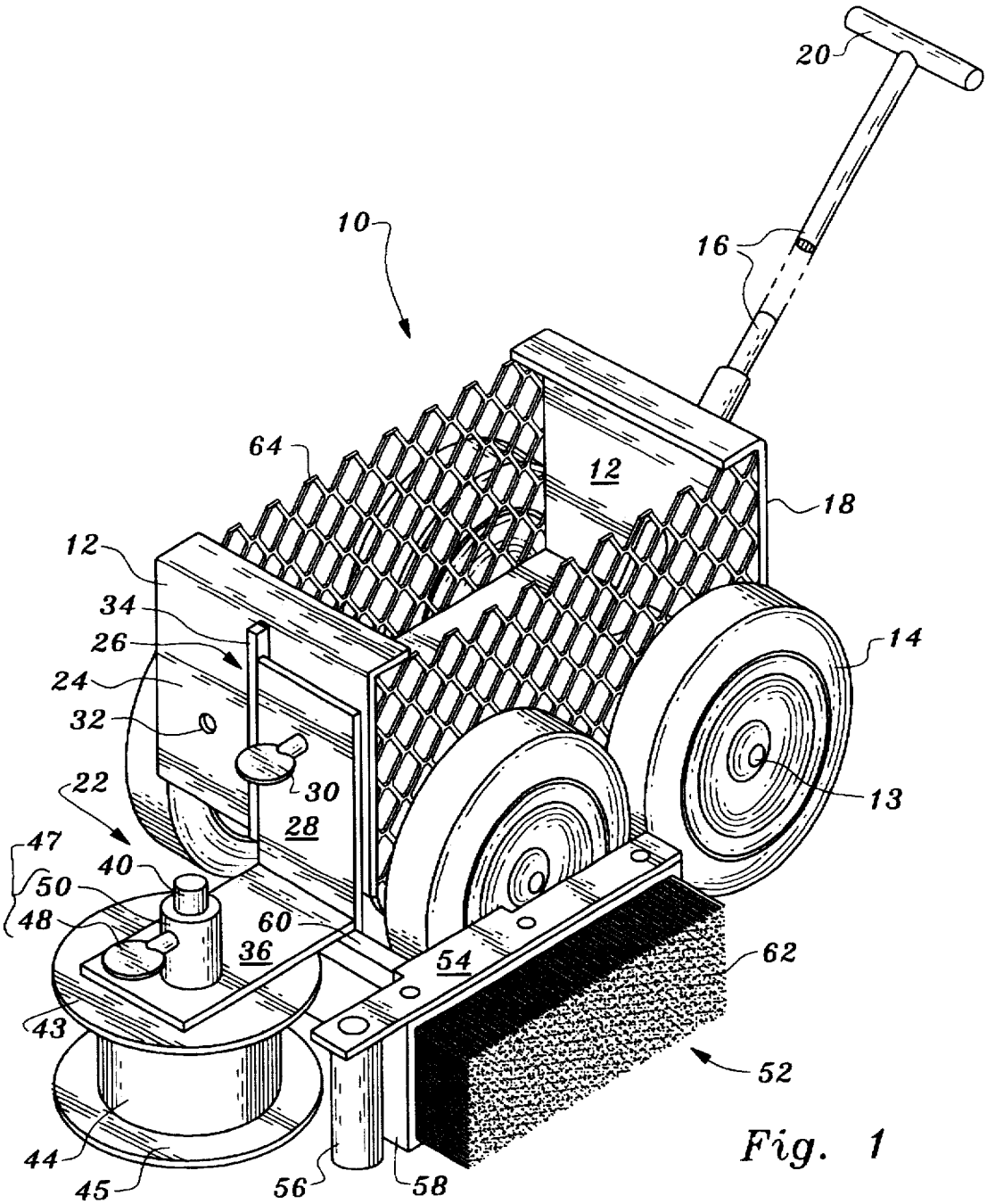
FIG. 1 is an elevated perspective view of the automatic taping apparatus which is the present invention.
Figure 2:
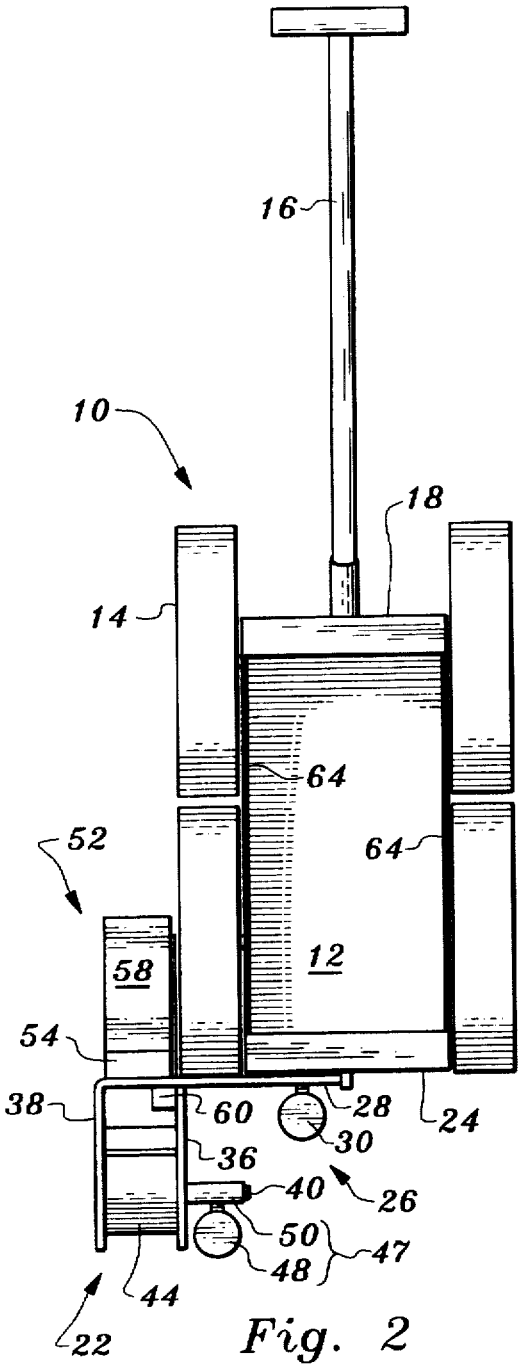
FIG. 2 is a plan view of the automatic taping apparatus depicted in FIG. 1.
Figure 3:
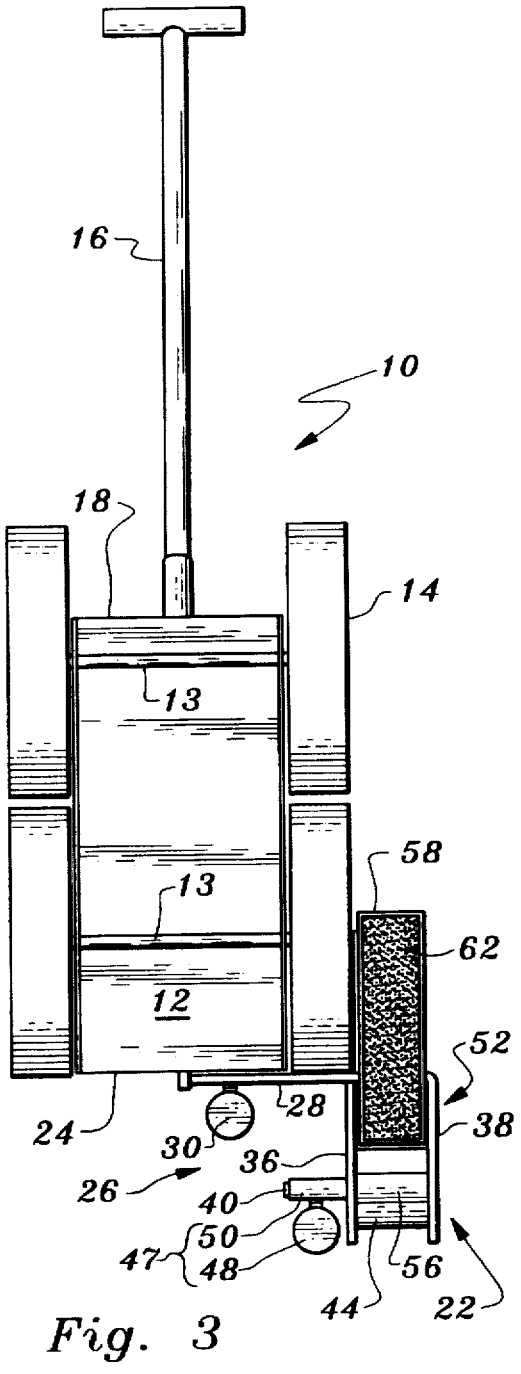
FIG. 3 is a bottom view of the automatic taping apparatus depicted in FIG. 1.

Referring more specifically to the drawings, the present invention is embodied in the automatic taping apparatus 10 generally shown in FIG. 1. It will be appreciated that this taping apparatus may vary as to configuration and as to details of the parts without departing from the basic concepts as disclosed herein.

FIG. 1 illustrates the general configuration of automatic taping apparatus 10 which is structured around a carriage body 12. Carriage body 12 is supported by wheels 14 which are set upon axles 13. Wheels 14 allow automatic taping apparatus 10 to be transported easily while taping a surface. Handle shaft 16 is coupled to the rear 18 of apparatus 10 and terminates at is uppermost portion at hand grip 20. Hand grip 20 is preferably of a height sufficient for grasping, thereby allowing a user to impart locomotion to the apparatus without stooping, kneeling, or bending. To these ends, handle shaft 16 may be made adjustable for differing statures. For example, it is within the scope of this invention for handle shaft 16 to be designed as a telescoping shaft, having different locking positions, for individuals with different statures. By incorporating these design elements, apparatus 10 can be used to tape work surfaces while the user walks in an upright, natural, and comfortable, position.

Figure 4:
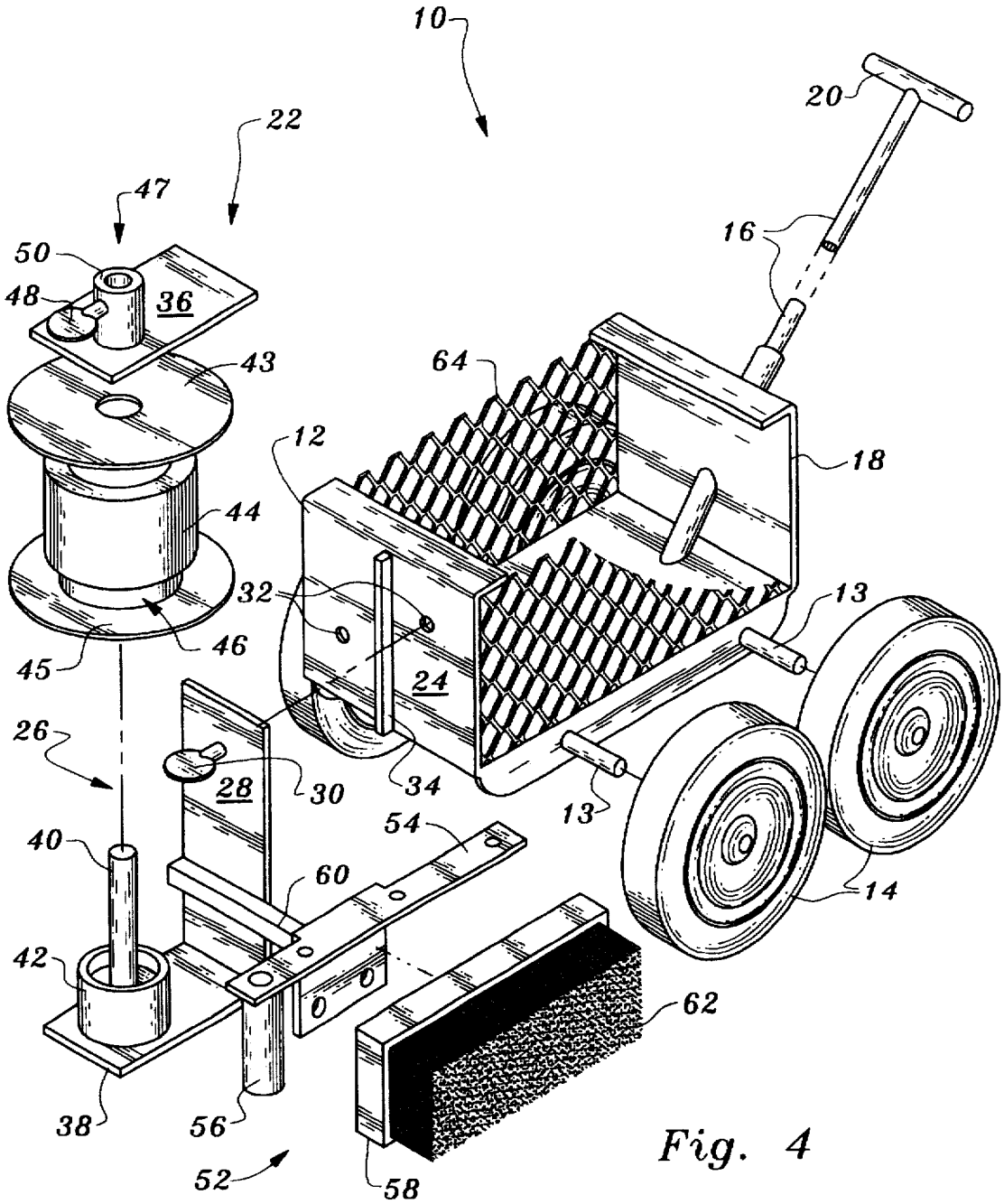
FIG. 4 is an exploded view of the automatic taping apparatus depicted in FIG. 1.

Referring also to FIGS. 2–6, the element of tape dispenser 22 can be examined. FIG. 4 shows tape dispenser 22 detached from the front 24 of carriage body 12. Coupling means 26 is a component of tape dispenser 22 and functions to allow tape dispenser 22 to be positioned in a plurality of geometric planes, for purposes of taping different surfaces. Any coupling means 26 which allows tape dispenser 22 to be rotated, and selectively positioned in different planes, would meet the requirements of the invention. Here, for example, coupling means 26 is shown as constructed from the components of a plate 28 and a push pin 30. Push pin 30 would include a depressible detente ball in its structure for detachably and selectively coupling to a plurality of holes 32 imparted into the front 24 of carriage body 12. Plate 28 abuts against barrier 34, thereby keeping coupling means 26, and the remainder of tape dispenser 22, in a stationary position.

Figure 5:
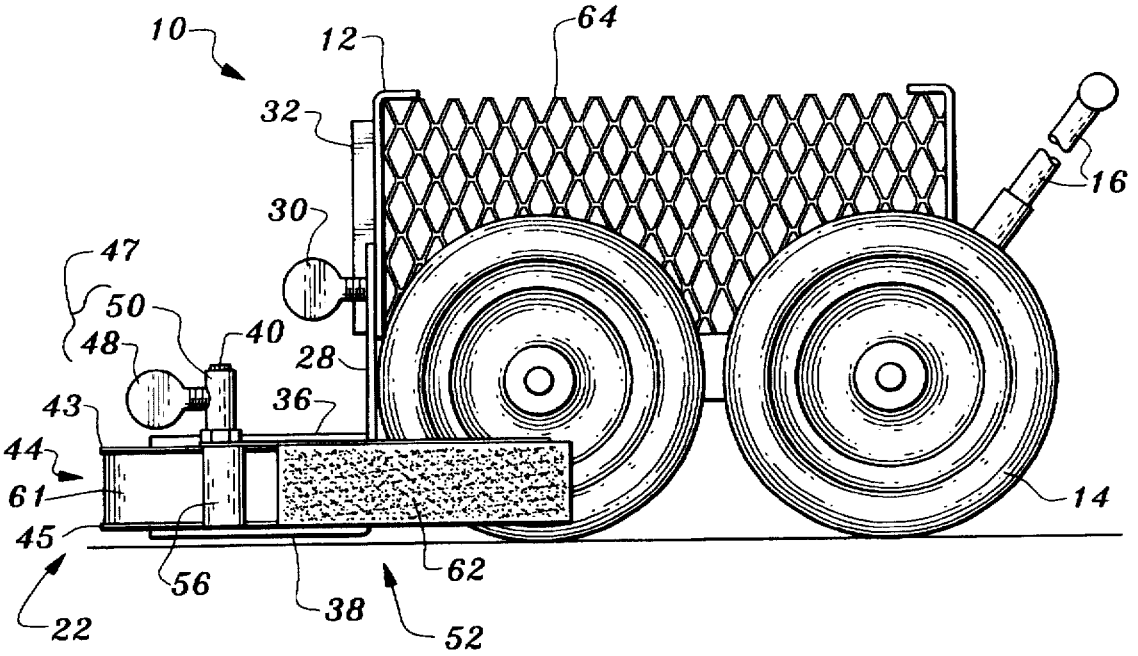
FIG. 5 is a side view of the automatic taping apparatus which is the present invention, with the tape dispenser positioned for taping a wall surface.
Figure 6:
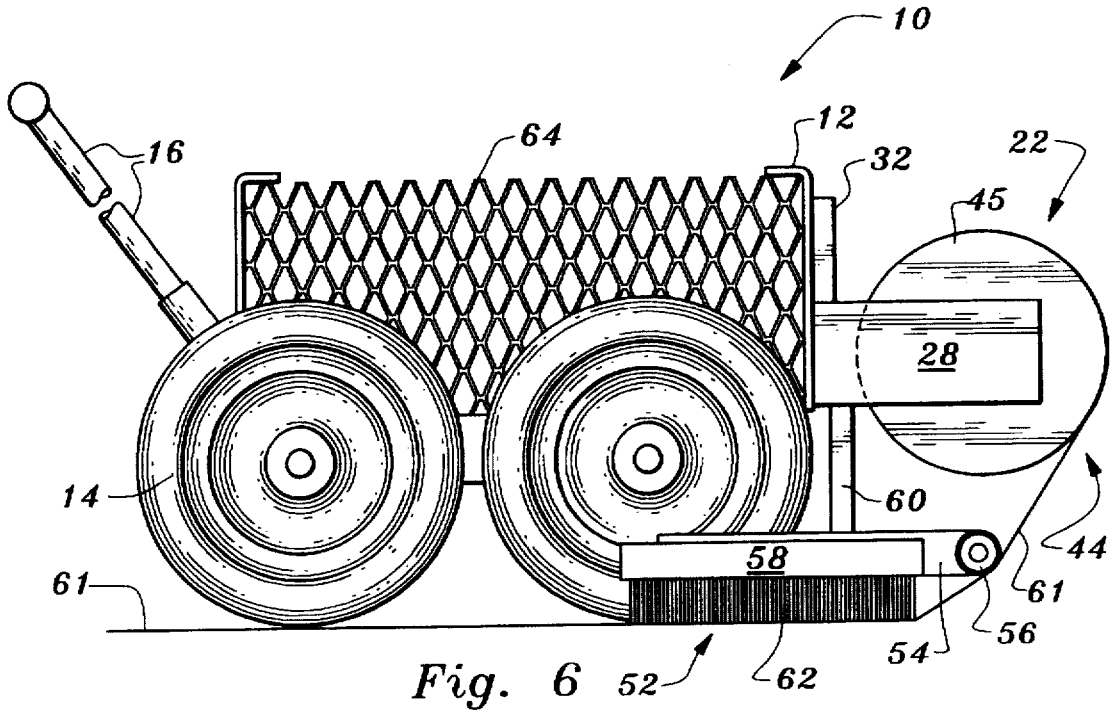
FIG. 6 is a side view of the automatic taping apparatus with the tape dispenser positioned for placing tape on a floor surface.

In use, push pin 30 can be uncoupled from a first hole 32 and tape dispenser 22 can then be rotated and re-coupled into a second hole 32, at a different geometric positioning. In this way, apparatus 10 can be readily adapted for applying tape to surfaces located in different geometric planes. FIGS. 5 and 6 clearly show how apparatus 10 is used to tape surfaces in different geometric planes.

In addition to coupling means 26, tape dispenser 22 is further comprised of a top release plate 36, a bottom bracket 38, a tape spindle 40 and a tape spool 42. Bottom bracket 38 abuts against plate 28 in a right-angled, perpendicular relation. Tape spindle 40 is preferably a straight shaft, or other upright structure, adapted for accepting the circular tape spool 42 which is preferably made of steel or other rigid, durable materials. The hollow cardboard frame center of a tape roll 44 wraps around tape spool 42 and tape spool 42 provides rigidity to tape roll 44, thereby preventing tape roll 44 from collapsing while taping a work surface. Additionally, tape spool 42 rotates easily upon tape spindle 40, allowing the tape to unroll easily from tape roll 44. Tape spool 42 can have a bearing, or similar means incorporated into its center for additional utility in unrolling tape from tape roll 44.

Top friction ring 43 and bottom friction ring 45 are placed above and below tape roll 44, respectively. Top and bottom friction rings 43, 45 are preferably flexible and coated with a low-friction material, such as Teflon, for example. Friction rings 43, 45 bias tape roll 44 between release plate 36 and bottom bracket 38, and facilitate the unrolling of tape roll 44 during the taping of a work surface. Bottom friction ring 45 has an open center 46 of a diameter sufficient for fitting over tape spool 42.

In use, tape spindle 40 protrudes upward through tape spool 42, which holds tape roll 44 upon tape dispenser 22. Release plate 36 couples upon tape spindle 40 by using a release means 47, here shown as a pull pin 48 coupled to a sleeve 50. Sleeve 50 slides over the top of tape spindle 40 and pull pin 48 couples to a notch on spindle 40. Spindle 40 preferably has a plurality of notches, at varying heights, along its length, for accommodating tape rolls having different widths. These notches allow release plate 36 to be intimately adjusted to the width of tape roll 44, thereby allowing tape roll 44 enough freedom to rotate freely, but also preventing tape roll 44 from moving significantly between release plate 36 and bottom bracket 38. By preventing tape roll 44 from moving on spindle 40, the tape is applied in an even and consistent manner.

Tape register 52 is comprised of bracket 54, a roller 56, coupled to the front of bracket 54, and brush 58 coupled to bracket 54. Tape register 52 couples to tape dispenser 22 by virtue of extension arm 60, which protrudes outward at 90 degrees from plate 28. Extension arm 60 is of a sufficient length for keeping tape register 52 free and clear of carriage body 12 and wheels 14, so that tape can be applied without obstruction. Tape dispenser 22 and tape register 52 uncouple from carriage body 12 as a single unit and are therefore selectively positioned upon carriage body 12 as a single unit.

As FIG. 6 clearly shows, tape register 52 functions to first, register the tape 61 against a work surface to start the taping process, and to secondly provide pressure against the tape 61 to adhere it to a work surface. Tape 61 must first be manually fed from tape roll 44 to tape register 52 to start the taping process. Brush 58 includes a bristle portion 62 which catches the edge of tape 61 as it comes off of tape roll 44, and applies it to a work surface. As apparatus 10 is pushed forward, tape 61 continues to unroll from tape roll 44, as bristle portion 62 applies tape 61 to a work surface. Roller 56 maintains tape 61 in a consistent line between tape roll 44 and bristle portion 62, and insures that tape 61 is rotatably fed to bristle portion 62 from tape roll 44, in a reliable and smooth manner.

Brush 58 preferably has a bristle portion 62 having a back-angled leading edge, because it has been found that angling the leading edge in this fashion provides a means of superior registration of tape 61 against a work surface, thereby allowing the taping process to be easily and reliably started. Additionally, bristle portion 62 is preferably of a width wider that the width of the roll of tape being applied to a surface. By keeping the width of bristle portion 62 wider than the tape being used, the fullest contact of tape 61 with the work surface is achieved. As different widths of tape 61 may be used with apparatus 10, brush 58 may be adapted to be uncoupled from bracket 54, so that brushes having bristle portions 62 of different widths can be used interchangeably, depending upon the width of tape required for a particular job.

Apparatus 10 has a storage basket 64 located in carriage body 12, for storing taping tools or extra rolls of tape. Storage basket 64 allows a user to replace a spent roll of tape with a fresh roll, and continue a taping task. Apparatus 10 is especially adapted for long-distance taping operations such as taping off areas to be painted on pavement, and surface streets, or else taping off moldings located in the interiors of large buildings.

Accordingly, this invention provides an automatic taping apparatus which allows a user to tape long distances of work surface without having to kneel, stoop, or bend to do so. This invention additionally allows a user to tape work surfaces arranged in different planes by employing a selectively positionable tape dispenser.

Although the description above contains many specificities, these should not be construed as limiting the scope of the invention, but as merely providing illustrations of some of the presently preferred embodiments of this invention. Thus the scope of this invention should be determined by the appended claims and their legal equivalents.

I claim:

1. An automatic taping apparatus, comprising:

a) a carriage body;

b) a handle coupled to an elongate handle shaft, said handle shaft coupled to a rear portion of said carriage body;

b) wheel means for allowing said apparatus to be wheeled about, said carriage body coupled to said wheel means;

c) tape dispensing means for dispensing tape to a work surface, said tape dispensing means further comprising a selectively positionable coupling means for coupling said tape dispensing means to a front portion of said carriage body, said coupling means coupling said tape dispensing means in a plurality of geometric planes; and d) tape registering means for firmly registering a length of tape upon a work surface, said tape registering means coupled to said tape dispensing means.

2. The apparatus as recited in claim 1, wherein said tape registering means is further comprised of a bracket, said bracket having a brush and a roller coupled thereto.

3. The apparatus as recited in claim 2, further comprising a coupling arm for coupling said bracket to said tape dispensing means.

4. The apparatus as recited in claim 3, wherein said selectively positionable coupling means further comprises a plate and a push pin, said push pin for engaging with a plurality of holes imparted into said front of said carriage body, said plate for resting against a barrier located on said front of said carriage body, said barrier holding said plate in a selected stationary position.

5. The apparatus as recited in claim 4, wherein said tape dispensing means further comprises a bottom bracket, a tape spindle, and a release plate, said tape spindle coupled perpendicularly to said bottom bracket, said bottom bracket coupled to said plate at a right angled relation, said release plate for coupling in a releasable fashion to said spindle.

6. The apparatus as recited in claim 5, further comprising a tape spool and a pair of friction rings, said tape spool for mounting a tape roll upon said spindle, said friction rings for biasing said tape roll between said bottom bracket and said release plate.

7. The apparatus as recited in claim 6, wherein said carriage body further comprises a storage basket imparted therein.

8. The apparatus as recited in claim 7, wherein said brush further comprises a bristle portion having a back-angled leading edge.

9. A taping apparatus for taping work surfaces in different geometric planes, comprising:

a) a carriage body, said carriage body having a front, a rear, a top and a bottom;

b) wheel means for allowing said carriage body to be wheeled about, said carriage body coupled to said wheel means;

c) a handle shaft having first and second ends, said first end of said handle shaft coupled to said rear of said carriage body, said second end of said handle shaft coupled to a hand grip located at an elevation for grasping by a user walking in an upright position;

d) a selectively positionable tape dispensing means for dispensing tape to a work surface, said tape dispensing means coupled to a front portion of said carriage body;

e) said tape dispensing means further comprising a selectively positionable coupling means for coupling said tape dispensing means in a plurality of geometric planes; and f) tape registering means for firmly registering a length of tape upon a work surface, said tape registering means coupled to said tape dispensing means by a coupling arm.

10. The apparatus as recited in claim 9, wherein said tape registering means is further comprised of a bracket, said bracket having a brush and a roller coupled thereto.

11. The apparatus as recited in claim 10, wherein said coupling means further comprises a plate and a push pin, said push pin for engaging with a plurality of holes imparted into said front of said carriage body, said plate for resting against a barrier located on said front of said carriage body, said barrier holding said plate in a selected stationary position and preventing said tape dispensing means from moving from said selected stationary position.

12. The apparatus as recited in claim 11, wherein said tape dispensing means further comprises a bottom bracket, a tape spindle, and a release plate, said tape spindle coupled perpendicularly to said bottom bracket, said bottom bracket coupled to said plate at a right angled relation, said release plate for coupling in a releasable fashion to said spindle.

13. The apparatus as recited in claim 12, further comprising a tape spool and a pair of friction rings, said tape spool for mounting a tape roll upon said spindle, said friction rings for biasing said tape roll between said bottom bracket and said release plate.

14. The apparatus as recited in claim 13 wherein said carriage body further comprises a storage basket imparted therein.

15. A taping apparatus for taping work surfaces in different geometric planes, comprising:

a) a carriage body, said carriage body having a storage basket imparted therein;

b) wheel means for allowing said carriage body to be wheeled about, said carriage body coupled to said wheel means;

c) a handle shaft having first and second ends, said first end of said handle shaft coupled to a rear portion of said carriage body, said second end of said handle shaft coupled to a hand grip;

d) a selectively positionable tape dispenser for dispensing tape to a work surface, said tape dispenser comprising:

ii) a plate and a push pin, said push pin for engaging with a plurality of holes imparted into said front of said carriage body, said plate for resting against a barrier located on a front portion of said carriage body, said barrier holding said plate in a selected stationary position and preventing said tape dispenser from moving from said selected stationary position; and ii) a bottom bracket, a tape spindle, and a release plate, said tape spindle coupled perpendicularly to said bottom bracket, said bottom bracket coupled to said plate at a right angled relation, said release plate for coupling in a releasable fashion to said spindle, said spindle for mounting a tape roll upon;

e) a coupling arm coupled to said plate at a first end of said coupling arm and to a bracket at an opposite end of said coupling arm, said bracket further comprising a roller and a brush coupled thereto, said roller for rotatably introducing a length of tape to said brush, said brush for firmly registering said length of tape upon a work surface.

16. The apparatus as recited in claim 15, further comprising a tape spool for mounting said tape roll on said tape spindle, and a pair of friction rings for biasing said tape roll between said bottom bracket and said release plate.

* * * * *